United States Patent [19]

Snow et al.

[11] Patent Number: 4,690,480

[45] Date of Patent: Sep. 1, 1987

[54] TUBULAR BI-METAL CONNECTOR

[75] Inventors: Wayne R. Snow, Jacksonville, Fla.; Gaston R. Isliker, Sidney, N.Y.; Colin A. Johnson, deceased, late of Jacksonville, Fla., by Barbara F. Johnson, executor

[73] Assignee: Allied Corporation, Morristown, N.J.

[21] Appl. No.: 780,536

[22] Filed: Sep. 26, 1985

[51] Int. Cl.[4] ..... H01R 13/504

[52] U.S. Cl. ..... 439/364; 174/50.61; 439/874; 439/935

[58] Field of Search ..... 339/136 S, 136 R, 136 M, 339/136 C, 137, 139 R, 139 C, 140 R, 140 C, 140 S, 141, 278 C, 143 R, 143 C, 143 S, 143 T, 218 R, 218 M, 218 L, 218 C, 14 R, 14 P, 275 E, 275 R, 276 E; 174/50.61, 50.63, 152 G M; 428/653

[56] References Cited

U.S. PATENT DOCUMENTS

| | | | |
|---|---|---|---|
| 3,233,312 | 2/1966 | Cowan et al. | 428/653 |
| 3,397,444 | 8/1968 | Bergmann et al. | 428/656 |
| 3,436,806 | 4/1969 | Supan | 428/653 |
| 3,853,390 | 12/1974 | DeKoeyer | 174/152 GM |
| 4,174,145 | 11/1979 | Oeschger et al. | 174/152 GM |

*Primary Examiner*—Gil Weidenfeld
*Assistant Examiner*—Thomas M. Kline
*Attorney, Agent, or Firm*—B. L. Lamb; R. M. Trepp

[57] ABSTRACT

An outlet terminal connector for electrical circuitry contained within a hermetically sealed housing. The connector includes a tubular shell having a threaded end portion composed of steel for releasably engaging a threaded mating cable connector and a base end portion composed of a different metal suitable for welding to the material of the housing. The connector shell is fabricated as a unitary assembly from a two layer explosively bonded laminate, one layer of which comprises steel and the other layer of which comprises the material of the connector base end portion.

6 Claims, 2 Drawing Figures

TUBULAR BI-METAL CONNECTOR

The present invention relates generally to electrical connectors. More particularly, it relates to an electrical connector having a tubular outer shell with the one end portion thereof adapted for releasable engagement with a threaded mating connector being composed of steel and with the opposite end portion thereof adapted for permanent attachment to a sealed housing being composed of a metal compatible for welding to the housing.

BACKGROUND

An ignition system for an aircraft turbojet engine typically comprises a spark discharge igniter plug located in the engine combustor which is supplied with high voltage oscillatory currents from an exciter circuit. The exciter circuit is located elsehwere on the engine in an environment less hostile than that in the vicinity of the engine combustor. The exciter is connected to the igniter by a length of shielded cable releasably fastened at each end by threaded connectors. For strength and reliability, the threaded parts of the mating connectors at both ends of the cable are formed of steel.

The exciter is enclosed in a hermetically sealed housing, typically formed of aluminum. Creating a reliable hermetic seal between a relatively thin-walled aluminum housing and a steel bodied outlet connector is difficult because of the incompatibility of the dissimilar metals to welding. Heretofore, an output connector having a tubular body formed entirely of steel has been secured to the aluminum exciter housing by a compression-type fitting threaded onto the base end of the connector shell. The connector shell encloses a center conductor pin supported coaxially within the shell by a ceramic insulator. Gas tight seals are formed between the pin and insulator by a fused glass bead and between the insulator and connector shell by a metal skirt or diaphragm bonded along one edge to the outer wall of the insulator and brazed along the other edge to the inner wall of the connector shell at the terminal end thereof. The base portion of the connector shell is hermetically sealed to the exciter housing by a film of solder sweated into place. The solder film forms a seal of weak mechanical strength which is generally inadequate to support the torsional load applied to the connector shell during attachment of the mating connector. Additional mechanical means in the form of pins or keys bridged between the housing and the connector base fitting must therefore be provided to resist torque loading at the connector base and such means are not fully satisfactory to guarantee that the integrity of the solder seal will remain intact.

It is an object of the invention to provide an electrical connector through which an electrical cable may be detachably coupled to circuitry contained within a hermetically sealed housing, the mating parts of the connector being threaded together and formed of high strength materials resistant to wear and damage through over tigthening.

It is another object of the invention to provide a tubular electrical connector having a threaded end portion adapted to receive a mating cable connector and a base portion adapted to be secured in a gas tight, torque resistant relationship to a thin-walled hermetically sealed housing, wherein the connector end portion and base portion are formed of different metals.

It is another object of the invention to provide a tubular connector having a threaded terminal end portion formed of steel and a base portion formed of a metal of a type suitable for welding to aluminum, whereby the connector may be secured to an aluminum housing to form a gas tight, torque resistant seal.

Briefly, the invention comprises an electrical connector having a tubular body or shell, the base portion of which is aluminum and the terminal portion of which is steel. The connector shell is fabricated from a cylindrical blank produced as a transverse punching through a composite laminate of aluminum and steel. The laminate is formed by explosively bonding together a relatively thick plate of steel and a relatively thick plate of aluminum, with the total thickness of the laminate being substantialy equal to the length of the connector shell. The steel portion of the shell is threaded to receive a mating cable connector and the aluminum portion of the shell is sealed by fusion welding into an aperture in a wall of an aluminum housing.

DETAILED DESCRIPTION

Figure 1:
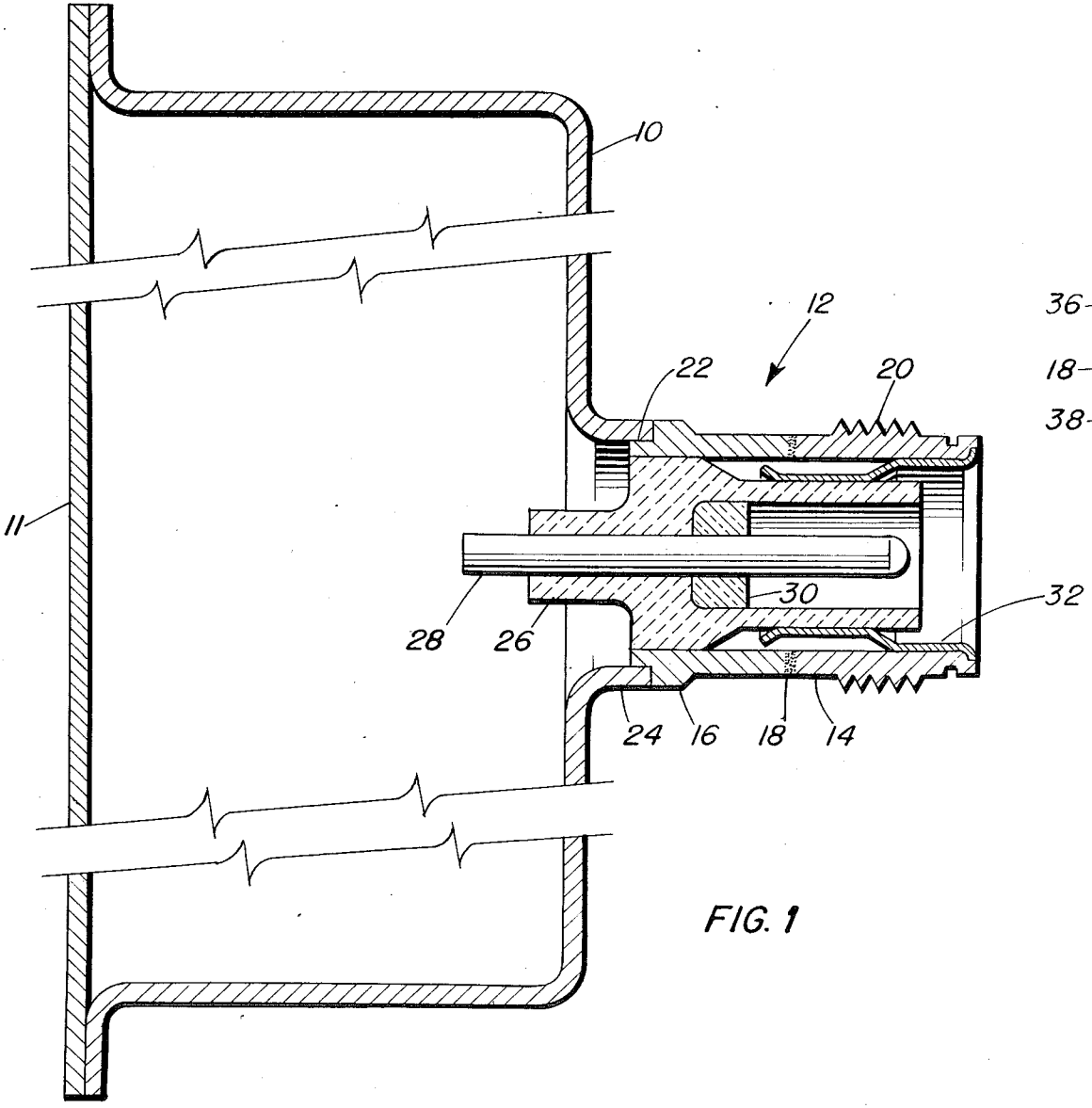
FIG. 1 is a sectional view of the connector of the invention showing a typical installation in a hermetically sealed housing.

Referring to FIG. 1, an aluminum housing 10 encloses high voltage circuitry elements (not shown) of an aircraft engine ignition system. To provide adequate insulation for the exciter components under severe operating conditions, housing 10 is closed by a cover plate 11 hermetically sealed in place. The high voltage ignition current output of the exciter is conducted to an engine igniter plug by a shielded cable which is releasably attached to the connector 12 of the invention. The ignition cable and the connector by which it is joined to connector 12 are not shown, but it will be understood that they are of standard construction with the cable connector being designed for attachment to connector 12 by threaded coupling means.

The tubular shell of connector 12 comprises a hollow cylindrical terminal end portion 14 formed of steel and a hollow cylindrical base end portion 16 formed of aluminum. Shell portions 14 and 16 are fabricated as a unitary prebonded assembly from a blank cut form an explosively bonded steel-aluminum laminate as hereinafter described. The bonding zone joining shell portions 14 and 16 is shown at 18. External theads 20 are formed on the steel terminal portion 14 to receive the threaded coupling means of the ignition cable connector.

A circumferential lip 22 turned on the end of aluminum base portion 16 fits snuggly within the upstanding wall 24 of an aperture formed in a wall of housing 10. A gas tight, high strength seal is formed between the connector base portion 16 and housing 10 by fusion welding between the contacting surfaces of shell lip 22 and aperture wall 24, such welding process being enabled by the utilization of aluminum as the material from which base portion 16 is formed.

The remaining elements of connector 12 are conventional and comprise a ceramic insulator 26 supporting a central contact pin 28, connected within the housing 10 to the output of the high voltage exciter circuit and leading to the exterior of the housing, where connection is made to the ignition cable conductor through a mating contact on the cable connector. Pin 28 is sealed in insulator 26 by a gas tight fused glass seal 30. Insulator 26 is secured within the shell of connector 12 by a thin cylindrical skirt 32 of nickel alloy material. Skirt 32 surrounds and is bonded to the outer peripheral surface of insulator 26 and extends forwardly in contact with the inner wall of shell portion 14 and is secured thereto by fusion welding. Connector 12 provides an entirely gas tight conduit through which the high voltage output of the exciter circuit within the housing 10 may be conducted to the engine igniter plug. Leakage of gas from housing 10 along pin 28 through insulator 26 is blocked by seal 30. The fusion weld joining the wall 24 of the housing aperture to shell lip 22 blocks gas leakage along that route, while skirt 32, bonded along one edge to insulator 26 and welded along the other edge to shell portion 14 prevents gas from seeping out of the housing through spaces between the peripheral wall of the insulator and inner wall of the shell.

Figure 2:
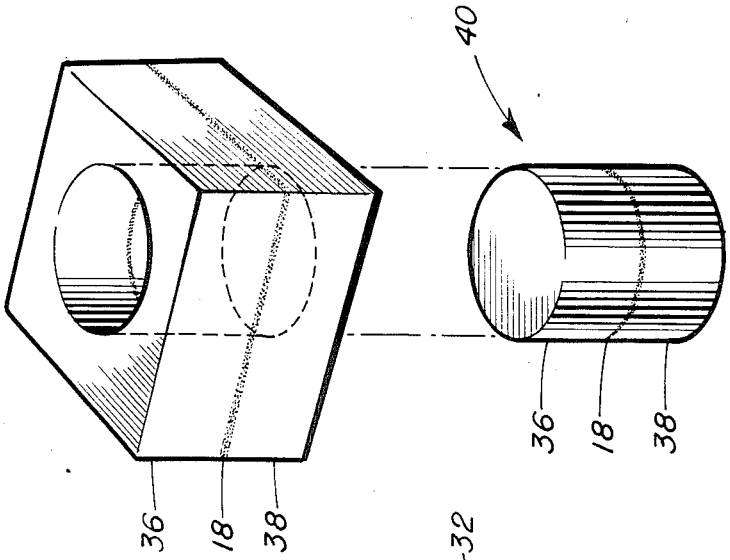
FIG. 2 is a perspective view of an explosively bonded laminate and a cylindrical blank produced therefrom from which the connector shell of the invention is fabricated.

FIG. 2 illustrates one method of fabricating the bonded shell portions 14 and 16 of the connector. The basic starting material is a flat plate laminate composed of a relatively thick upper plate 36 of steel explosively bonded to a relatively thick lower plate 38 of aluminum. Plates 36 and 38 are explosively bonded together using processes as described in U.S. Pat. Nos. 3,233,312; 3,397,444 or 3,493,353 or variations thereof, as known to those skilled in the art. A wide variety of dissimilar metals may be bonded together in this manner without the constraints imposed upon other bonding methods by requirements of compatibility of materials. The resultant laminate exhibits a bonding zone 18 described in U.S. Pat. No. 3,233,312 as "multi-component, interatomic mixtures of the substance of the metallic cladding and backer layers". Further, according to U.S. Pat. No. 3,233,312, the laminate or "composite system" produced by explosive bonding has a shear strength of greater than about 75% of that of the weaker metal in the system.

A cylindrical blank 40 produced as a transverse punching or otherwise cut transversely from the laminate may be shaped by conventional machining methods as if the entire shell of connector 12 were being turned from a uniform bar of material. The threaded terminal end portion 14 of the connector shell is, of course, formed from the steel layer 36 of blank 40, while the base end portion 16, to be welded into the aluminum housing, is formed from the aluminum layer 38 of the blank.

The invention provides a tubular threaded connector having a terminal end portion formed of durable, wear and damage resistant material and a base end portion formed of a material compatible for welding into a thin-walled housing, the material of which is generally not similar to and is not suitable for welding to the material of the connector terminal end portion. Obviously the specification herein of particular materials for fabrication of the elements of the invention is not intended to restrict the practice of the invention solely to the use of such materials. The invention may be practiced otherwise than as specifically disclosed without departing from the spirit and scope of the appended claims.

The invention claimed is:

1. An electrical connector adapted to be secured to a housing by welding, comprising, an outer shell;

electrical contact means supported within and insulated from said shell;

said shell being fabricated as a unitary structure from a composite laminate of first and second layers of distinctly different materials which have been explosively bonded together;

said first layer being of a material having a higher shear strength than the material of said second layer, the material of said second layer being of a type suitable for welding to the material of the housing, whereby one end of said shell is formed of the material composing said first of said layers of laminate and the opposite end of said shell is formed of the material composing said second of said layers of laminate.

2. A connector as claimed in claim 1 wherein said first layer is composed of steel and said second layer is composed of aluminum.

3. A connector providing an electrical output terminal for an electrical circuit contained within a hermetically sealed housing, comprising a hollow elongated shell, an electrical insulating body;

means supporting said insulating body within said shell and providing a gas tight seal to prevent leakage of gas between said insulating body and said shell;

an electrical contact extending through and supported by said insulating body; and means for sealing said electrical contact in said insulating body to prevent leakage of gas between said electrical contact and said insulating body;

said shell being formed by first and second abutting portions joined together by explosive bonding, said first portion being composed of a first metal having the property of high strength required in a durable detachable coupling, the said second portion being composed of a second metal distinctly different from said first metal, said second metal having the properties required for welding to the material from which the housing is formed, whereby said connector may be secured in an aperture in a wall of the housing by welding said second portion of said shell thereto to provide a gas tight joint therewith which is resistant to torque applied to said shell, said second portion providing a durable, wear resistant shell portion for mating with a detachable coupling and said electrical contact providing a conductive path from the interior to the exterior of the housing.

4. A connector as claimed in claim 3 wherein said shell is tubular in form with said first portion thereof having threads formed thereon for engaging a threaded mating electrical cable connector.

5. A connector as claimed in claim 3 wherein said first metal is steel and said second metal is of a type suitable for welding to aluminum.

6. A connector as claimed in claim 5 wherein said second metal is aluminum.

* * * * *